US008905405B1

(12) United States Patent
Burns, Sr.

(10) Patent No.: US 8,905,405 B1
(45) Date of Patent: Dec. 9, 2014

(54) PORTABLE HORSESHOE GAME ASSEMBLY

(71) Applicant: Jesse Von Burns, Sr., University City, MO (US)

(72) Inventor: Jesse Von Burns, Sr., University City, MO (US)

( * ) Notice: Subject to any disclaimer, the term of this patent is extended or adjusted under 35 U.S.C. 154(b) by 142 days.

(21) Appl. No.: 13/649,270

(22) Filed: Oct. 11, 2012

(51) Int. Cl.
*A63B 67/06* (2006.01)

(52) U.S. Cl.
USPC ..... 273/336; 273/348

(58) Field of Classification Search
USPC ..... 273/317, 336–339, 342, 348
See application file for complete search history.

(56) References Cited

U.S. PATENT DOCUMENTS

| | | | | | |
|---|---|---|---|---|---|
| 915,450 | A * | 3/1909 | Levey | 273/336 |
| 1,098,872 | A * | 6/1914 | Akerberg | 273/336 |
| 1,328,711 | A * | 1/1920 | Carr | 273/285 |
| 1,541,897 | A * | 6/1925 | Buedingen | 273/336 |
| 3,356,368 | A * | 12/1967 | Dixon | 273/336 |
| 3,547,442 | A | 12/1970 | Fenicchia | |
| 3,844,560 | A | 10/1974 | Litsch | |
| 4,314,702 | A | 2/1982 | Updike et al. | |
| D266,678 | S | 10/1982 | Herrmann | |
| 4,952,073 | A | 8/1990 | Wieland | |
| 4,964,644 | A | 10/1990 | Hull et al. | |
| 4,982,966 | A * | 1/1991 | Teafatiller | 273/338 |
| D328,765 | S * | 8/1992 | Strom, Jr. | D21/304 |
| 5,620,185 | A * | 4/1997 | Robertson | 273/338 |
| 7,500,674 | B2 * | 3/2009 | Riley et al. | 273/400 |
| 7,726,656 | B1 | 6/2010 | Kuchcinski et al. | |
| 2008/0029963 | A1 | 2/2008 | Cornfield | |
| 2010/0181726 | A1 | 7/2010 | Bos | |

* cited by examiner

*Primary Examiner* — Nini Legesse

(57) ABSTRACT

A portable horseshoe game assembly facilitates playing a game of horseshoes at any desired location. The assembly includes a pair of boxes. Each box has a bottom panel and a perimeter wall extending upwardly from a perimeter edge of the bottom panel. Each of a pair of covers is coupled to an associated one of the boxes. Horseshoes and posts are provided. Each post is coupled to the bottom panel of an associated one of the boxes. A container has a bottom wall and a peripheral wall extending continuously around and upwardly from a peripheral edge of the peripheral wall. A lid is coupled to the peripheral wall of the container and sand is positioned in the container.

15 Claims, 5 Drawing Sheets

PORTABLE HORSESHOE GAME ASSEMBLY

BACKGROUND OF THE DISCLOSURE

Field of the Disclosure

The disclosure relates to game devices and more particularly pertains to a new game device for facilitating playing a game of horseshoes at any desired location.

SUMMARY OF THE DISCLOSURE

An embodiment of the disclosure meets the needs presented above by generally comprising a pair of boxes. Each box has a bottom panel and a perimeter wall extending upwardly from a perimeter edge of the bottom panel. Each of a pair of covers is coupled to an associated one of the boxes. Horseshoes and posts are provided. Each post is coupled to the bottom panel of an associated one of the boxes. A container has a bottom wall and a peripheral wall extending continuously around and upwardly from a peripheral edge of the peripheral wall. A lid is coupled to the peripheral wall of the container and sand is positioned in the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
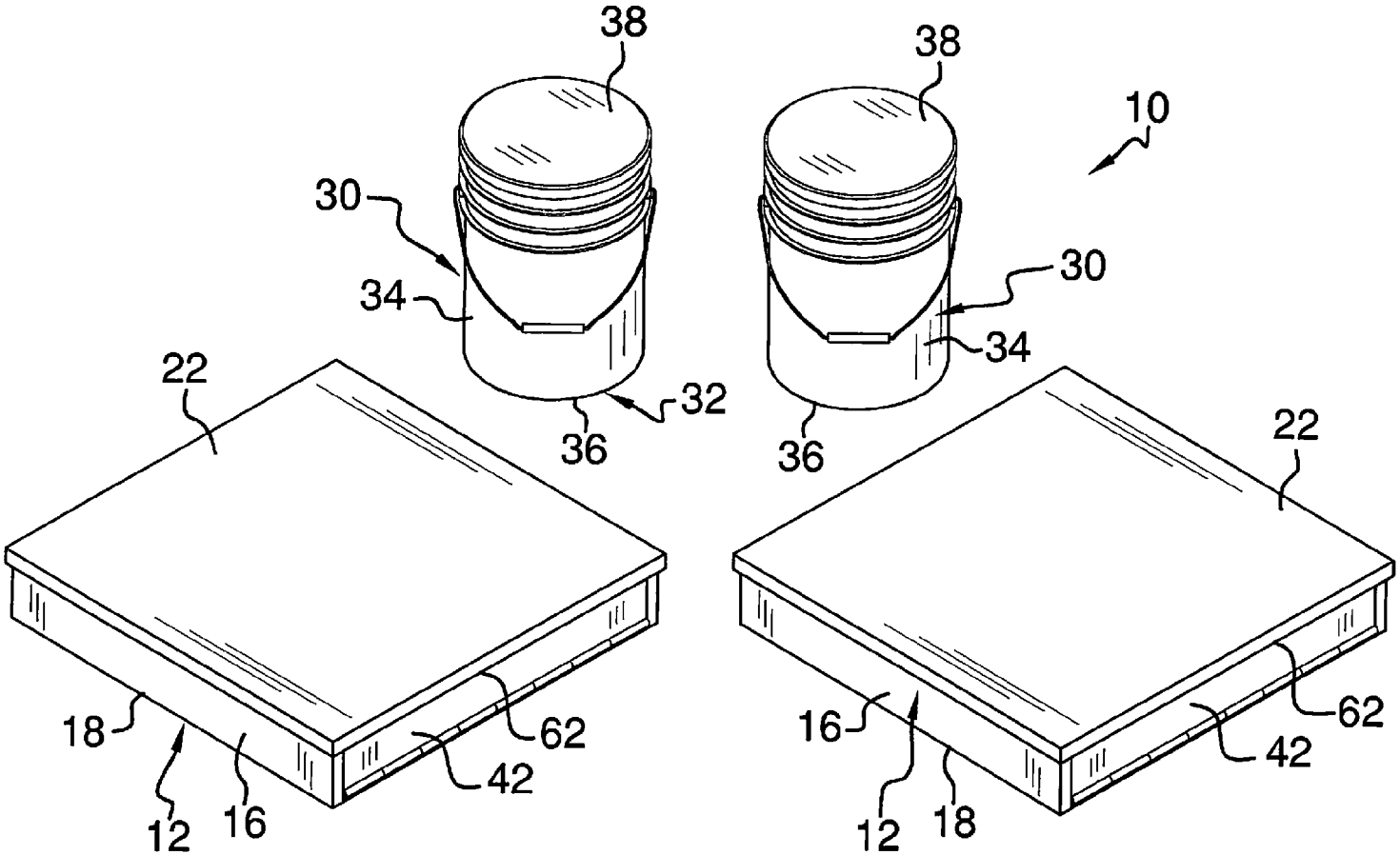
FIG. 1 is a top front side perspective view of a portable horseshoe game assembly according to an embodiment of the disclosure.
Figure 2:
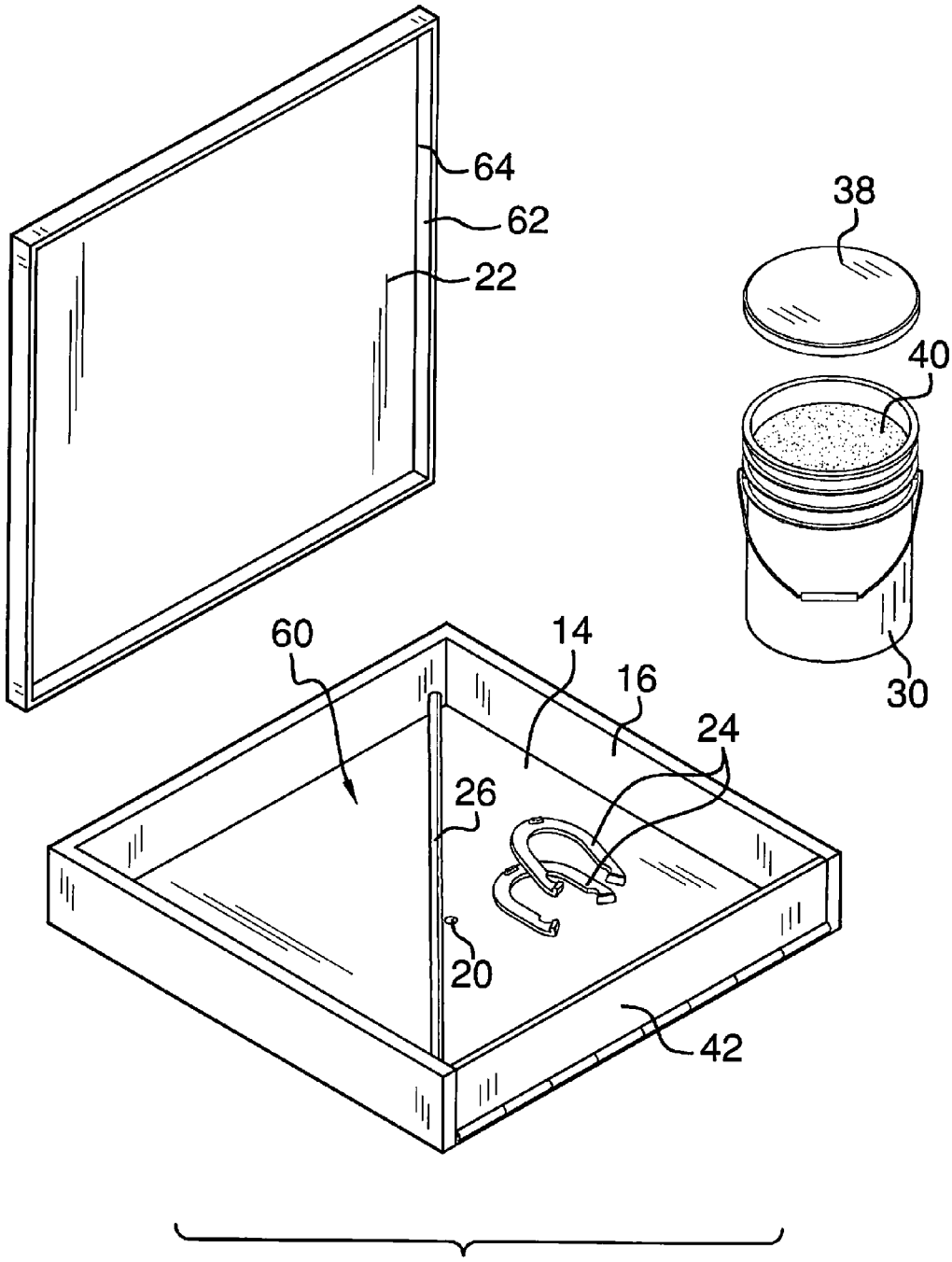
FIG. 2 is a partially exploded top front side perspective view of an embodiment of the disclosure.
Figure 3:
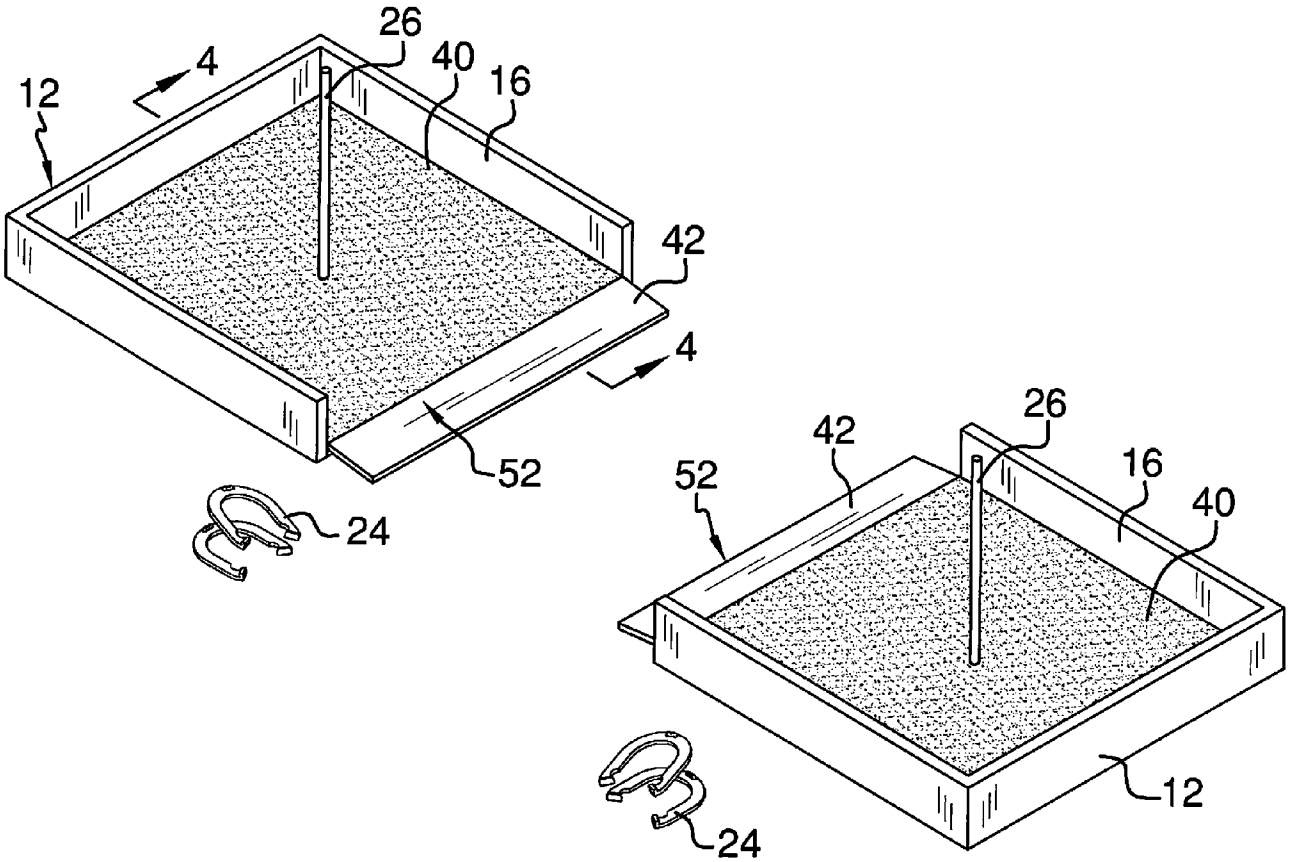
FIG. 3 is a top front side perspective view of an embodiment of the disclosure.
Figure 4:
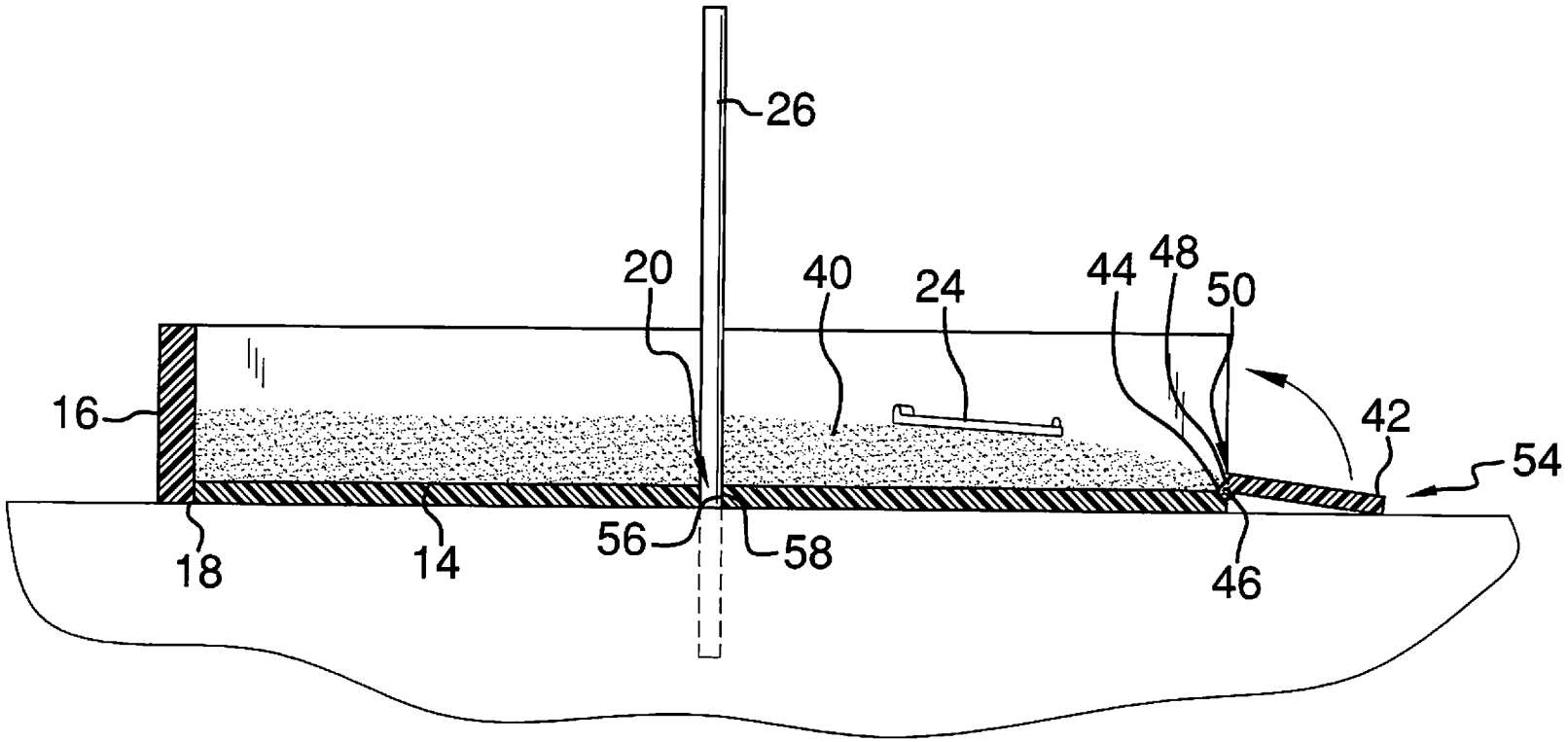
FIG. 4 is a cross-sectional view of an embodiment of the disclosure taken along line 4-4 of FIG. 3.
Figure 5:
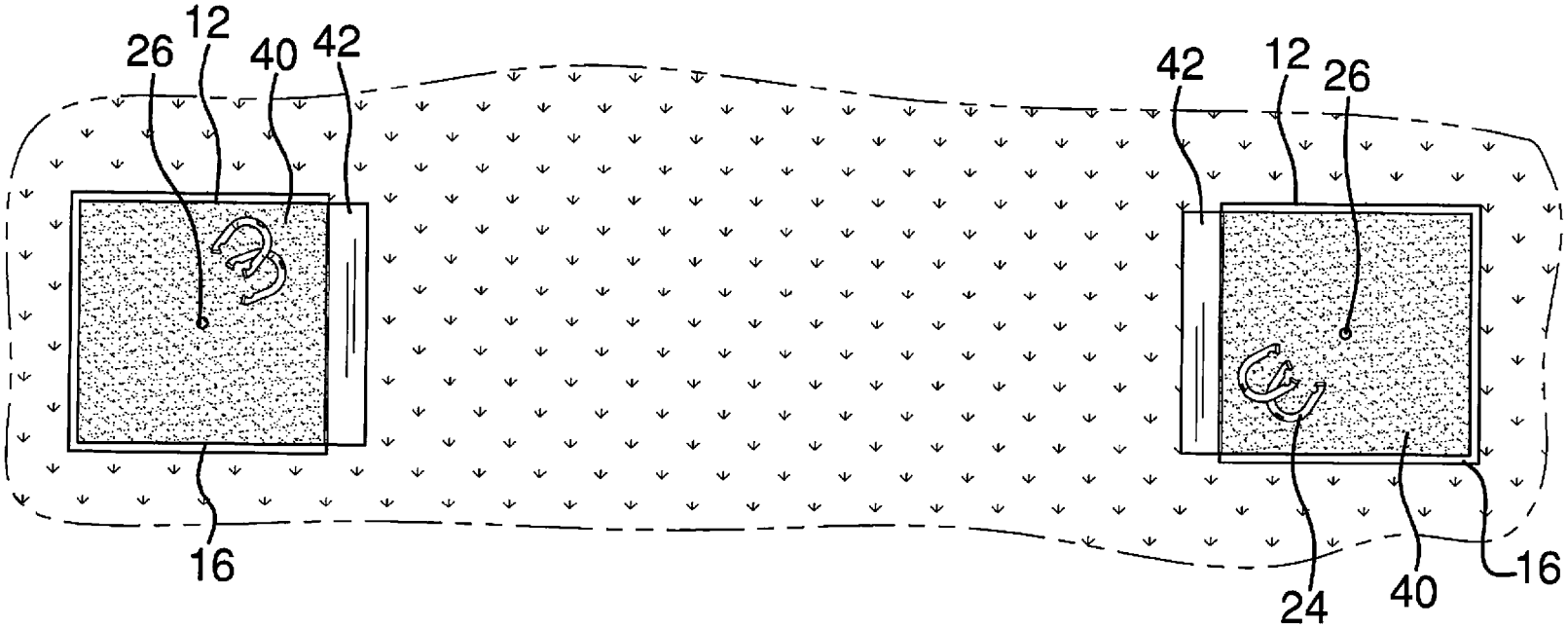
FIG. 5 is a top view of an embodiment of the disclosure in a deployed position.

With reference now to the drawings, and in particular to FIGS. 1 through 5 thereof, a new game device embodying the principles and concepts of an embodiment of the disclosure and generally designated by the reference numeral 10 will be described.

As best illustrated in FIGS. 1 through 5, the portable horseshoe game assembly 10 generally comprises a pair of boxes 12 having identical dimensions. Each box 12 has a bottom panel 14 and a perimeter wall 16 extending upwardly from a perimeter edge 18 of the bottom panel 14. The bottom panel 14 of each box 12 has a cavity 20. The cavity 20 in the bottom panel 14 of each box 12 is centrally positioned on the bottom panel 14. The cavity 20 may extend fully through the bottom panel 14 of the box 12. A pair of covers 22 is provided. Each cover 22 is coupled to an associated one of the boxes 12. A plurality of horseshoes 24 is provided. The horseshoes 24 are positionable in the boxes 12 for storage and transport. A pair of posts 26 is also provided. Each post 26 is couplable to the bottom panel 14 of an associated one of the boxes 12. The associated post 26 has a lower end 28 insertable into the cavity 20 of each bottom panel 14 whereby the post 26 extends transversely up from the bottom panel 14.

A container 30 has a bottom wall 32 and a peripheral wall 34 extending continuously around and upwardly from a peripheral edge 36 of the peripheral wall 34. A lid 38 is coupled to the peripheral wall 34 of the container 30. Sand 40 is positioned in the container 30. The sand 40 is positionable in the boxes 12 when ready to play a game. Two containers 30 may be provided with equal amounts of sand 40 in each container 30 to facilitate fair and even distribution of sand 40 into each box 12.

A front panel 42 of the perimeter wall 14 of each box 12 may be pivotally coupled to the perimeter edge 18 of the bottom panel 14. The front panel 42 of the perimeter wall 16 of each box 12 is positionable to extend outwardly from the bottom panel 14. An outer lower edge 44 of the front panel 42 of the perimeter wall 16 of each box 12 is pivotally coupled to an upper outer edge 46 of the bottom panel 14 whereby a bottom side 48 of the front panel 42 forms a lip 50 extending across a front section 52 of the box 12 when the front panel 42 is in a deployed position 54. The lip 50 assists in retaining sand 40 in each box 12 during play.

An outer surface 56 of the post 26 abuts a perimeter edge 58 of the cavity 20 when the lower end 28 of the post 26 is inserted through the cavity 20. This also facilitates retention of sand 40 in the box 12 during play. Each post 26 has a length less than a diagonal distance across each box 12 whereby each post 26 is positionable in an interior space 60 of each box 12. Each cover 22 has a lip 62 extending downwardly from a perimeter edge 64 of the cover 22. The lip 62 extends over and around the perimeter wall 16 of the box 12 when the cover 22 is coupled to the box 12. Thus, the lip 62 prevents the front panel 42 from pivoting outwardly when the cover 22 is coupled to the box 12.

In use, all the necessary parts for a game of horseshoes is provided in the assembly 10. Each box 12 is positioned at a desired distance apart. The posts 26 are inserted through the cavities 20 securing the boxes 12 in place. Sand 40 is added to the boxes 12 and the front panels 42 are pivoted into the deployed position 54. Turns may then be taken to play the game of horseshoes. When the game is over, the sand 40 is returned to the container 30 and the posts 26 and horseshoes 24 may be stored in the boxes 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A portable horseshoe game assembly comprising:

a pair of boxes, each box having a bottom panel and a perimeter wall extending upwardly from a perimeter edge of said bottom panel;

a pair of covers, each cover being coupled to an associated one of said boxes;

a plurality of horseshoes;

a pair of posts, each post being couplable to said bottom panel of an associated one of said boxes;

a container having a bottom wall and a peripheral wall extending continuously around and upwardly from a peripheral edge of said peripheral wall;

a lid coupled to said peripheral wall of said container;

sand positioned in said container; and a front panel of said perimeter wall of each said box being pivotally coupled to said perimeter edge of said bottom panel.

2. The assembly of claim 1, further including said front panel of said perimeter wall of each said box being positionable to extend outwardly from said bottom panel.

3. The assembly of claim 1, further including said bottom panel of each said box having a cavity, said associated post having a lower end insertable into said cavity whereby said post extends transversely up from said bottom panel.

4. The assembly of claim 3, further including said cavity in said bottom panel of each said box being centrally positioned on said bottom panel.

5. The assembly of claim 1, further including an outer lower edge of said front panel of said perimeter wall of each said box being pivotally coupled to an upper outer edge of said bottom panel whereby a bottom side of said front panel forms a lip extending across a front section of said box when said front panel is in a deployed position.

6. The assembly of claim 3, further including said cavity extending fully through said bottom panel of each said box.

7. The assembly of claim 6, further including an outer surface of said post abutting a perimeter edge of said cavity when said lower end of said post is inserted through said cavity.

8. The assembly of claim 1, further including each said post having a length less than a diagonal distance across each said box whereby each post is positionable in an interior space of each said box.

9. The assembly of claim 1, further including each said cover having a lip extending downwardly from a perimeter edge of said cover, said lip extending over and around said perimeter wall of said box when said cover is coupled to said box whereby said lip prevents said front panel from pivoting outwardly when said cover is coupled to said box.

10. A portable horseshoe game assembly comprising:

a pair of boxes, each box having a bottom panel and a perimeter wall extending upwardly from a perimeter edge of said bottom panel, said bottom panel of each said box having a cavity, said cavity in said bottom panel of each said box being centrally positioned on said bottom panel, said cavity extending fully through said bottom panel of each said box;

a pair of covers, each cover being coupled to an associated one of said boxes;

a plurality of horseshoes;

a pair of posts, each post being couplable to said bottom panel of an associated one of said boxes, said associated post having a lower end insertable into said cavity whereby said post extends transversely up from said bottom panel;

a container having a bottom wall and a peripheral wall extending continuously around and upwardly from a peripheral edge of said peripheral wall;

a lid coupled to said peripheral wall of said container;

sand positioned in said container, said sand being positionable in said boxes;

a front panel of said perimeter wall of each said box being pivotally coupled to said perimeter edge of said bottom panel, said front panel of said perimeter wall of each said box being positionable to extend outwardly from said bottom panel;

an outer lower edge of said front panel of said perimeter wall of each said box being pivotally coupled to an upper outer edge of said bottom panel whereby a bottom side of said front panel forms a lip extending across a front section of said box when said front panel is in a deployed position;

an outer surface of said post abutting a perimeter edge of said cavity when said lower end of said post is inserted through said cavity;

each said post having a length less than a diagonal distance across each said box whereby each post is positionable in an interior space of each said box; and each said cover having a lip extending downwardly from a perimeter edge of said cover, said lip extending over and around said perimeter wall of said box when said cover is coupled to said box whereby said lip prevents said front panel from pivoting outwardly when said cover is coupled to said box.

11. A portable horseshoe game assembly comprising:

a pair of boxes, each box having a bottom panel and a perimeter wall extending upwardly from a perimeter edge of said bottom panel;

a pair of covers, each cover being coupled to an associated one of said boxes;

a plurality of horseshoes;

a pair of posts, each post being couplable to said bottom panel of an associated one of said boxes;

a container having a bottom wall and a peripheral wall extending continuously around and upwardly from a peripheral edge of said peripheral wall;

a lid coupled to said peripheral wall of said container;

sand positioned in said container;

said bottom panel of each said box having a cavity, said associated post having a lower end insertable into said cavity whereby said post extends transversely up from said bottom panel; and said cavity extending fully through said bottom panel of each said box.

12. The assembly of claim 11, further including said cavity in said bottom panel of each said box being centrally positioned on said bottom panel.

13. The assembly of claim 11, further including an outer surface of said post abutting a perimeter edge of said cavity when said lower end of said post is inserted through said cavity.

14. The assembly of claim 11, further including each said post having a length less than a diagonal distance across each said box whereby each post is positionable in an interior space of each said box.

15. The assembly of claim 11, further including each said cover having a lip extending downwardly from a perimeter edge of said cover, said lip extending over and around said perimeter wall of said box when said cover is coupled to said box whereby said lip prevents said front panel from pivoting outwardly when said cover is coupled to said box.

* * * * *